United States Patent [19]

Stetter

[11] Patent Number: 4,800,033

[45] Date of Patent: Jan. 24, 1989

[54] PROCESS FOR THE NON-CUTTING RESHAPING OF METALS, AND LUBRICANT COMPOSITIONS FOR THIS PROCESS

[76] Inventor: Karl Stetter, Leibl-Str. 6, D-8200, Rosenheim, Fed. Rep. of Germany

[21] Appl. No.: 22,948

[22] PCT Filed: May 27, 1986

[86] PCT No.: PCT/EP86/00318

§ 371 Date: Jan. 27, 1987

§ 102(e) Date: Jan. 27, 1986

[87] PCT Pub. No.: WO86/07087

PCT Pub. Date: Dec. 4, 1986

[30] Foreign Application Priority Data

May 28, 1985 [DE] Fed. Rep. of Germany ..... 3519078

[51] Int. Cl.[4] ..... C10M 107/02

[52] U.S. Cl. ..... 252/55; 252/565; 585/10; 585/12

[58] Field of Search ..... 252/55, 56 S; 585/10, 585/12

[56] References Cited

U.S. PATENT DOCUMENTS

| | | | |
|---|---|---|---|
| 3,000,825 | 9/1961 | Wanless et al. . | |
| 3,250,103 | 5/1966 | Beaubien . | |
| 3,756,954 | 9/1973 | Abbott et al. | 252/55 |
| 4,372,863 | 2/1983 | Elliott et al. | 252/55 |
| 4,455,244 | 6/1984 | Smyser et al. | 252/55 |

FOREIGN PATENT DOCUMENTS

| | | |
|---|---|---|
| 0028384 | 5/1981 | European Pat. Off. . |
| 50524 | 10/1981 | European Pat. Off. . |
| 2201862 | 7/1973 | Fed. Rep. of Germany . |
| 2909517 | 9/1980 | Fed. Rep. of Germany . |
| 3047915 | 7/1982 | Fed. Rep. of Germany . |
| 3227102 | 2/1984 | Fed. Rep. of Germany . |
| 3421479 | 12/1984 | Fed. Rep. of Germany . |
| 1312676 | 11/1962 | France . |
| 1426791 | 12/1965 | France . |
| 2270319 | 12/1975 | France . |
| 1507823 | 4/1978 | United Kingdom . |

OTHER PUBLICATIONS

DE-Z: VDI-Z 121, 1979, Nr.9, Mai (I), S.445-455.
DE-Z: Maschinenmarkt, Wurzburg, 79, 1973: S-14-09-1411.
DE-Z: Ausz. aus OS (Wila), Teil 1, 1978; 2704175.
DE-Z: Pat. Schnellberichte 1964, Teil A, A02-181/64 (RA152046).
DE-Z: Chemicsche Zentralblatt 1960, S.1380/1381.
DE-Z: Chemisches Zentralblatt 1960, S.1047.
GB-Z: CPI-Basic-Abstracts Journal, 1980, 33964B/18 (Y0054037106).
GB-Z: CPI-Basic-Abstracts Journal, 1979, 08095B/05 (CA1046047).
GB-Z: CPI-Basic-Abstracts Journal, 1978, 03562A/02 (SU 551354).
GB-Z: CPI-Basic-Abstracts Journal, 1974, 25476V/14 (JP48028504).
US-Z: Chemical Abstracts, 1977, vol. 87, Ref. 8504j.

*Primary Examiner*—Jacqueline V. Howard
*Attorney, Agent, or Firm*—Nixon and Vanderhye

[57] ABSTRACT

A process for non-cutting reshaping of metals using polymers in the form of homopolymers and copolymers of 1-olefins, of oxidation products of such homopolymers or copolymers, or of saponification or esterification products of these oxidation products as lubricants. The polymers are solid and preferably have melting points above 100° C. and melt viscosities of greater than 100 mPa s at 170° C., the acid indices in the oxidation products having a value of greater than 5.

These lubricants can be employed in pure solid form or in the form of compositions in which they are present as a mixture with lubricant additives and/or suspending agents, dispersing agents or solvents which are known per se.

18 Claims, No Drawings

PROCESS FOR THE NON-CUTTING RESHAPING OF METALS, AND LUBRICANT COMPOSITIONS FOR THIS PROCESS

Shaped metallic parts are frequently produced by non-cutting reshaping, the workpiece, with or without prewarming, being given the desired shape by means of the action of high external forces. Types of non-cutting metal reshaping are, for example, wire drawing, bar drawing, tube drawing, section drawing, deep drawing and ironing, furthermore cold extrusion, cold heading, pilgering, cold and warm rolling, or forging.

It is known that lubricants can be employed in the non-cutting reshaping of metals in order to improve the results by reducing the friction between the workpiece and the form tool. Mineral oils, with or without high-pressure additives, animal and vegetable oils, fats and waxes, and also metal soaps based on fatty acids, particularly based on stearic acid, are employed as lubricants.

When the known lubricants are used, the non-cutting reshaping of metals leads, in many respects, to unsatisfactory results. The desired high degrees of reshaping and reshaping speeds are frequently not achieved. The aimed-at dimensional accuracies and surface qualities of the workpieces and adequately long tool lives are also not achieved as a result of cold welding and grooving. In addition, the metal surfaces are stained or corroded and the environment is badly polluted by the chlorine-, sulfur- and phosphorous-containing additives which are often necessary in conventional lubricants in order to achieve a detectable lubricating effect. The disadvantages mentioned occur in particular in relatively difficult cases of metal reshaping, for example in the case of wire drawing, tube drawing, section drawing, cold extrusion or drop forging of steel, above all in the case of relatively high-alloy steels. In relatively difficult cases, metal reshaping is generally only possible at all using conventional lubricants if additional separating agent or lubricant carrier coatings are applied to the workpiece surface before the reshaping. The separating agent or lubricant carrier coatings must generally be applied chemically, in a complicated fashion, by reaction of, usually, certain salt solutions with the workpiece surface with formation of corresponding coatings on the workpiece surface (for example "phosphating", "oxalating"). Physical apolication by allowing salt solutions to dry on the workpiece surface is also only adequate in less difficult cases, but physical application frequently orovides completely unsatisfactory results. In addition, the separating coatings often impair the surface quality of the workpieces and require high expenditure for their removal before further processing of the workpieces, during which, in addition, waste water which requires working up is produced. Moreover, the action of the separating or carrier coatings is frequently insufficient to achieve acceptable reshaping results in difficult metal reshaping cases.

The invention is based on the object of simplifying the procedure in the case of non-cutting reshaping of metals and of improving the results.

This object is achieved according to the invention in that the metal reshaping is carried out using a lubricant, which is used, if appropriate, in combination with separating agent and/or lubricant carrier coatings, wherein the lubricant is selected from a group comprising polymers of 1-olefins, oxidation products of such polymers, and esterification and saponification products of the oxidation products mentioned, and also mixtures of the substances mentioned, this lubricant being employed in pure form or as a mixture with other mixture components of lubricants which are known per se.

The advantages which are achieved using the invention compared to known processes are, in particular, that higher degrees of reshaping and higher reshaping speeds, furthermore higher dimensional accuracies and better surface qualities of the workpieces, and also longer tool lives, are achieved. The reshapings can also be carried out with markedly lower energy expenditure and reduced environmental pollution. In addition, the application of additional separating agent or lubricant carrier coatings can in many cases be simplified or completely omitted.

Polymers of 1-olefins which are employed as lubricants in the process according to the invention are taken to mean homopolymers of $C_2$–$C_{18}$-alkenes having a terminal double bond, preferably the $C_2$–$C_{12}$-alkenes, above all ethylene, propene, 1-butene, 3-methyl-1-butene, 1-pentene, 1-hexene and 1-octene, and also copolymers of these 1-olefins with one another, and furthermore copolymers of these 1-olefins with up to 50, preferably up to 30, particularly up to 20, but above all up to 15% by weight of oxygen-containing 1-olefins.

Polymers are, for example, the commercially available polyethylenes, polypropylenes, polybutylenes etc. as are obtained by known processes, for example by high, medium or low pressure polymerization. Copolymers of the 1-olefins simultaneously contain at least two different 1-olefin units. These include, for example, polyethylenes containing up to 30, preferably up to 20, particularly up to 10% by weight of other 1-olefins, such as propene, 1-butene etc. The copolymers, recently available under the name LLDPE, of ethylene with higher 1-olefins are also to be included here. Copolymers of the 1-olefins with oxygen-containing olefins are, for example, copolymers of ethylene with vinyl esters of carboxylic acids, such as vinyl acetate or vinyl propionate, furthermore with vinyl ethers or 1,2-ethylenically unsaturated carboxylic acids and the derivatives thereof, such as acrylic acid, methacrylic acid, ethacrylic acid, crotonic acid, fumaric acid, maleic acid, maleic anhydride, itaconic acid, mesaconic acid or the esters of these acids. The polymers used are not subject to any limitation with respect to their structure and their molecular size. For example, polymers having high or low degrees of branching can be used. It is also possible to employ low molecular weight waxy polymers having molecular weights between 200 and 20,000 (melt viscosities about 5 to 100,000 mPa s at 160° C.) and high molecular weight, plastic-like polymers having molecular weights between 20,000 and 5,000,000 (melt indices MFI 190/2.16 about 1000 to 0.001 g/10 minutes). The lower molecular weight polymers having molecular weights between 200 and 100,000, preferably between 500 and 30,000, advantageously between 800 and 20,000, in particular between 1,000 and 15,000, but above all between 3,000 and 10,000, are particularly well suited. The main polymers to nave excellent lubricant properties for the reshaping of metals, particularly, for example, in deep drawing or ironing, are those simultaneously having high melting points (>100, preferably >110, particularly >115, above all >120° C.), high melt viscosities (>100, preferably >500, particularly >1,000, above all >10,000 mPa s at 170° C.), and high crystallinities (>10, preferably >30, particularly >40, above all 50%). Copolymers which are also constructed from oxygen-containing monomer units are scarcely crystalline and have lower melting points, but still have specifically further improved lubricant properties due to the polarity given in them.

Oxidation products of the polymers are taken to mean products which are generally produced by air oxidation of the polymers. They can be prepared by known processes, for example from low molecular weight polymers by mixing the polymers in the melted condition with air, or, particularly advantageously, from high molecular weight polymers by treating the polymers in the solid condition or in the melted condition finely distributed in an inert dispersing agent with air at elevated temperatures. The oxidates have acid indices between 5 and 150, preferably between 10 and 70, advantageously between 15 and 50, particularly between 20 and 45 mg of KOH/g, and melt viscosities between 5 and 100,000, preferably between 50 and 50,000, advantageously between 100 and 30,000, particularly between 500 and 20,000, above all between 1,000 and 15,000 mPa s at 160° C. Their melting points are above 90, preferably above 100, particularly above 110, above all above 115° C. The melting points of the oxidates of copolymers tend to be in the lower of tne ranges specified. Oxidates having high dicarboxylic acid content (>10,preferably >20, advantageously >40, particularly >60, above >80% by weight), as are produced in the oxidation of higher molecular weignt polymers (molecular weigrts >5,000, preferably >10,000), and oxidates simultaneously having comparatively high melting points, high melt viscosities, high crystallinities and high polarities, in particular, have excellent properties as lubricants in metal reshaping, even in relatively difficult cases.

The esterification and/or saponification products of the oxidates are obtained by partially or completely esterifying or saponifying or initially partially esterifying and then partially or completely saponifying the carboxyl groups which are still free using monohydric or polyhydric alcohols or using univalent to trivalent metal ions or using ammonium ions.

Suitable esterification components are primarily: monohydric $C_1$–$C_{22}$-alkanols, dihydric alcohols, such as 1,2-ethanediol, 1,2-propanediol, 1,4-butanediol or ether alcohols, such as diethylene glycol and higher polyalkylene glycols, furthermore higher-hydric alcohols, such as trimethylolpropane or pentaerythrite, if appropriate as a mixture with one another. $Li^+$, $Na^+$, $K^+$, $Mg^{2+}$, $Ca^{2+}$, $Ba^{2+}$, $Zn^{2+}$, $Pb^{2+}$, $Al^{3+}$, $NH^{4+}$ and ammonium ions of organic amines in the form of their hydroxides, carbonates, acetates, stearates inter alia salts are generally employed as saponification components, if appropriate as a mixture with one another. The esterification or saponification is generally carried out in a known fashion by stirring the melted oxidates with the esterification or saponification components, if appropriate in the presence of suitable catalysts, until the desired degree of esterification or saponification is reached. The esterification or saponification can alternatively be carried out by intimately mixing the solid powdered, suspended, dispersed or dissolved oxidates with the solid, suspended, dispersed or dissolved coreactants. If suspended, dispersed or dissolved coreactants are used, the product produced can be employed in moist, if appropriate in suspended or dispersed form, or, after drying, in powdered form for the process according to the invention. In another embodiment, the saponification products can be prepared by stirring the oxidation products or the partially pre-esterified oxidation products in the melted condition, if appropriate with addition of emulsifiers, with the saponification components dissolved or dispersed in water. Aqueous solutions or dispersions of the saponification products which can also be advantageously employed as such for the process according to the invention are produced during this.

The saponification products, less so the esterification products, generally have increased melting points and melt viscosities compared to the basic oxidates. In the case of the saponification products, the melting points are greater than 100, preferably greater than 110, particularly greater than 120, advantageously greater than 130, above all greater than 140° C., and the melt viscosities are greater than 100, preferably greater than 500, particularly greater than 1,000, advantageously greater than 3,000, above all greater than 5,000 mPa s at 180° C. The lower of the ranges specified tend to be valid for the esterification products. The esterification and/or saponification products have, in a certain respect, further optimized lubricant properties compared to the oxidates by means of a specifically-given combination of comparatively high melting points, high melt viscosities, high crystallinities and also by means of a specific balance between polar and nonpolar components. The saponification products, above all, which form lubricant films having specifically outstanding lubricating, adhesive and separating power and also increased tear resistance and which retain these properties even when subject to extreme pressures and temperatures, have proven particularly advantageous. The esterified and, above all, the saponified oxidation products are therefore suitable, in a very particular fashion, for use as lubricants for difficult reshapings of metals, for eample for tube drawing, section drawing, wire drawing, pilgering, rolling, cold extrusion, upset forming or forging, preferably for metals which are difficult to deform, such as steels, above all high-alloy steels, also stainless steels, for example acid-resistant chromium and chromium-nickel steels.

The polymers whose oxidates or the esterification and/or saponification products of the oxidates can be employed as lubricants for the reshaping of metals for the process according to the invention on their own, as a mixture with one another, or as a mixture with other substances. Other suitable mixture components are, for example, mineral oils, vegetable or animal oils, fats, waxes or resins, and also fatty acids, fatty alcohols, soaps, synthetic resins or oils, preferably polyalkylene glycols and the derivatives thereof, very low molecular weight polyethylenes, or esters. Furthermore, in order to round off the properties, conventional additives, such as high pressure active compounds (for example chlorine-, sulfur- or phosphorus-containing substances), furthermore pigments and fillers (for example lime, chalk, talc, borax, soda, mica, graphite, molybdenum disulfide, tungsten disulfide, boron nitride, iodine, glass), emulsifiers, surfactants, wetting agents, thickeners (for example montmorillonite), adhesion improvers, binders, corrosion inhibitors and antioxidants can be mixed with the lubricants in the process according to the invention.

The polymers, the oxidates thereof, or the esterification and/or saponification products of the oxidates can be employed for the process according to the invention as lubricants in the form of powders, suspensions, dispersions or solutions. In powder form, the lubricants have a pourability which is advantageously good for use and which, in contrast to the conventional lubricants, is retained even at higher atmospheric humidity. In the case of suspensions, dispersions and solutions, water, mineral oils, natural or synthetic oils and chlorinated hydrocarbons, if appropriate as a mixture with one another, preferably serve as suspending agent, dispersing agent or solvent. Due to a solvent-promoting action both in the preparation of the lubricants according to the invention and in the removal thereof from tne metal surface, polyalkylene glycols have proven particularly advantageous here. The suspensions and dispersions can be prepared with addition of known ionic or nonionic emulsifiers and wetting agents. The lubricants are applied to the workpieces by known processes, for example by powdering, brushing, dipping, flooding, spraying or in a continuous flow process, if appropriate at elevated temperatures and with subsequent drying of the workpiece.

The process according to the invention can be advantageously applied in all types of non-cutting reshaping of metals, for example in wire drawing, bar drawing, tube drawing, section drawing, deep drawing, stretch forming and ironing or in cold extrusion, cold heading, embossing, reducing, pilgering, rolling, cutting and forging. The process is not limited to cold reshaping of metals, but includes semiwarm and warm reshaping of metals, for example warm rolling, drop forging or extrusion, in particular also in the case of nonferrous metals. The advantages of the procedure according to the invention become apparent, in particular, in relatively difficult reshaping processes, for example in tube drawing, section drawing, wire drawing, tube pilgering, rolling, cold extrusion, upset forming or forging.

The process according to the invention is advantageously suitable for the reshaping of all common metallic materials, for example low-carbon or high-carbon steels, non-alloyed, low-alloy or high-alloy steels, stainless steels, zinc-plated, copper-plated or other metal-coated steels, nonferrous metals such as magnesium, aluminum, copper, brass, bronze, zinc, lead, nickel, titanium, zirconium, tungsten and the alloys thereof. The advantages of the process according to the invention apply, in particular, in the reshaping of metals which are difficult to reshape, for example in the case of austenite and ferrite steels, particularly high-alloy, above all non-rusting steels, preferably stainless steels, for example acid-resistant chromium or chromium-nickel steels, furthermore in the case of zinc-plated steels. Due to the excellent lubricant action of the lubricants employed, several succeeding reshapings are generally possible in the process according to the invention without intermediate relubrication.

Due to the excellent lubricating, adhesion and separating power and the exceptional film strength of the lubricants employed, the additional application of a separating agent or lubricant carrier coating onto the workpiece before reshaping can generally be omitted in the process according to the invention, even in the case of difficult reshaping processes. Compared to known reshaping processes, costs are thereby reduced, waste water problems are reduced, and surface qualities of the final products are improved. However, the lubricants employed can also be used in combination with known separating agent or lubricant carrier coatings in the process according to the invention. In many cases, further advantages can thereby be achieved in the case of particularly difficult reshapings of metals, for example in the drawing of stainless steel sections with complicated shapes or in cold extrusion. The more simple physical application of the separating agent or lubricant carrier coatings by allowing appropriate solutions or dispersions to dry on the workpiece surface (for example liming/ boraxing) is generally sufficient here in order to achieve excellent results. The more complicated chemical application of the separating agent or lubricant carrier coatings by chemical reaction of appropriate solutions or dispersions with the workpiece surface (for example phosphating, oxalating, copper-plating) only brings additional advantages in extreme cases.

Due to the excellent lubricant action of the lubricants employed, higher degrees of reshaping and greater reshaping speeds, furthermore greater dimensional accuracies and better surface qualities of the workpieces, and also longer tool lives are generally achieved in the process according to the invention in comparison to known processes. Cold-welding, with the connected impairment of the workpiece surfaces by grooving and impairment of the tool lives by surface welding, does not occur or only occurs to a considerably reduced extent. The process according to the invention furthermore reduces the energy consumption and the production of waste water.

The process according to the invention is also distinguished by the fact that lubricants are used which do not contain any noxious substances or substances such as chlorine, sulfur, phosphorus or boron which have a disadvantageous effect on the properties of the processed materials, for example as a result of staining and corrosion, and which considerably pollute the environment. The lubricants do not have a corrosive effect on metals, but instead have a corrosion-protective effect. They can be removed, if required, from the metal surface after the reshaping by conventional cleaning methods without leaving a residue, using simple agents and methods, for example using conventional alkaline, neutral or acidic cleaners or, alternatively, using organic solvents. The fact that the lubricants used can also be removed from the workpiece surface by evaporation without leaving a residue by simple vacuum/heat treatment, for example in the preliminary stage to the heat aftertreatment of the workpiece, is a specific advantage of the process according to the invention.

EXAMPLES 1 to 9

Cups are produced from stainless steel sheeting in the deep-drawing process using the polymers listed in the table below as lubricants.

| Example No. | Type of polymer | Melting point °C. | Melt viscosity mPa s (170° C.) | MFI 190/2.16 g/10 minutes | Crystallinity % |
|---|---|---|---|---|---|
| 1 | branched polyethylene | 116 | 830 | — | 25 |
| 2 | linear polyethylene | 124 | 520 | — | 59 |
| 3 | linear polyethylene | 133 | 29,000 | — | 62 |
| 4 | linear polyethylene | 134 | — | 15 | 68 |
| 5 | ethylene/propylene copolymer (5% by weight of propene) | 126 | — | 8 | 38 |
| 6 | branched poly- | 112 | — | 18 | 12 |

-continued

| Example No. | Type of polymer | Melting point °C. | Melt viscosity mPa s (170° C.) | MFI 190/2.16 g/10 minutes | Crystallinity % |
|---|---|---|---|---|---|
| | ethylene | | | | |
| 7 | polypropylene | 158 | 2,500 | — | 68 |
| 8 | ethylene/ vinyl acetate copolymer (8% of vinyl acetate) | 100 | — | 3 | — |
| 9 | ethylene/acrylic acid copolymer (6% of acrylic acid) | 108 | 560 | — | — |

The polymer are dissolved in xylene and applied to the sheeting in a thin coating using a brush. After evaporation of the solvent, cups are drawn from the sheets. cups having high dimensional accuracy and high surface quality (low roughness, high gloss and pale color) are obtained, the Examples 3, 8 and 9 leading to the best relative results. Further improved results are obtained on addition of conventional high-pressure active compounds.

Identical deep-drawing experiments using conventional drawing oils as lubricants require significantly greater stamp forces and give products having markedly lower surface quality.

EXAMPLES 10 to 17

Blank steel wire having a carbon content of 0.85% is drawn by employing the oxidation products of polymers listed in the table below as lubricants.

| Example No. | Type of oxidate | Properties of the oxidate m.p.* °C. | AI* | SI* | MV* | Reshaping results achieved drawing speed, m/sec | Surface quality |
|---|---|---|---|---|---|---|---|
| 10 | polyethylene oxidate | 128 | 15 | 24 | 5100 | 13 | good |
| 11 | polyethylene oxidate | 118 | 24 | 38 | 1600 | 15 | very good |
| 12 | polyethylene oxidate | 108 | 68 | 95 | 150 | 14 | good |
| 13 | polyethylene oxidate | 101 | 41 | 56 | 350 | 14 | very good |
| 14 | polyethylene oxidate | 114 | 17 | 31 | 150 | 10 | satisfactory |
| 15 | ethylene/vinyl acetate copolymer oxidate | 103 | 18 | 90 | 4200 | 14 | very good |
| 16 | polyethylene oxidate | 105 | 16 | 29 | 410 | 9 | satisfactory |
| 17 | polyethylene oxidate | 102 | 26 | 48 | 280 | 10 | good |

*m.p. = melting point, AI = acid index, SI = saponification index, MV = melt viscosity (mPa s at 140° C.)

The lubricants are employed in solid condition in that the wire is run through the powdered lubricant before reaching the tool. The diameter of the wire is reduced to ¼ of the original value over 15 draws. The reshaping results specified in the table are achieved.

If the drawing experiment is carried out using conventional lubricants, for example based on fatty acid soaps, consistently lower drawing speeds and less good wire surfaces are obtained. In addition, greater drawing die wear occurs in the case of conventional lubricants.

EXAMPLES 18 to 25

Stainless steel wire is drawn by employing aqueous-alkaline dispersions of oxidation products of polymers as lubricants.

The process is started from the same oxidation products of polymers as in Examples 10 to 17. The oxidation products are initially converted into aqueous-alkaline dispersions by dispersing them in the melted condition with the amounts, calculated according to the acid index, of potassium hydroxide and together with emulsifiers (5% by weight of ethoxylated fatty alcohol, relative to the oxidate) in hot water. Dispersions having the properties listed in the following table are obtained.

| Example No. | Oxidate employed Oxidate as in Example No. | Properties of the dispersion Solids content, % by weight | pH | Viscosity mPa s | Reshaping results achieved Drawing speed m/sec | Surface quality |
|---|---|---|---|---|---|---|
| 18 | 10 | 6 | 9 | 15 | 5 | good |
| 19 | 11 | 4 | 8 | 13 | 7 | very good |
| 20 | 12 | 5 | 8 | 6 | 6 | good |
| 21 | 13 | 4 | 8 | 8 | 6 | very good |
| 22 | 14 | 6 | 8.5 | 10 | 4 | satisfactory |
| 23 | 15 | 3 | 8 | 15 | 6 | very good |
| 24 | 16 | 5 | 9 | 10 | 4 | satisfactory |
| 25 | 17 | 6 | 8.5 | 8 | 5 | good |

The stainless steel wire (Z 2 CN 18-10) is coated with each of the lubricant dispersions by dipping and subsequent drying, and is deformed over 15 drawings from the initial diameter of 6.5 mm to the final diameter of 1.2 mm. The reshaping results specified in the table are achieved. The results are consistently markedly better than those obtained under identical conditions using conventional lubricants. The wire is grooved and sometimes breaks when conventional lubricants are used. Similar results are achieved using the lubricants listed above when they are employed for drawing stainless steel tubes. Results which are approximately as good can be achieved using conventional lubricants only when polluting and corrosive lubricants based on chlorinated paraffin are used or when the tubes are initially pretreated in a complicated fashion by oxalation and then aftertreated using specific fatty acid soaps.

If the lubricants according to the invention are employed with addition of small amounts of polyalkylene glycols, they can be removed from the metal surface particularly easily after the reshaping is complete.

EXAMPLES 26 to 33

Lubricants are prepared by converting the oxidation products of polymers used in Examples 10 to 17 into saponification products. For this purpose, the powdered oxidation products are saponified by mixing with the equivalent amount of potassium hydroxide solution. The experimental products listed in the following table are obtained.

| Example No. | Oxidate employed Oxidate as in Example No. | Properties of the saponification products m.p. °C. | Acid index mg of KOH/g | mPa s (190° C.) | Reshaping results Dimensional accuracy | Surface quality |
|---|---|---|---|---|---|---|
| 26 | 10 | >190 | 2 | — | good | good |
| 27 | 11 | >190 | 3 | — | very good | very good |
| 28 | 12 | >190 | 5 | — | good | good |
| 29 | 13 | >190 | 4 | — | very good | very good |
| 30 | 14 | 188 | 2 | >20,000 | satisfactory | satisfactory |
| 31 | 15 | 172 | 2 | >30,000 | very good | good |
| 32 | 16 | 176 | 3 | >20,000 | satisfactory | satisfactory |
| 33 | 17 | 187 | 3 | >20,000 | good | satisfactory |

Four symmetrically arranged grooves each of depth 5 mm and width 5 mm are drawn in one drawing into cylindrical rods of austenite chrome-nickel steel of diameter 30 mm, the saponification products of polymers listed in the table above being employed as lubricants. The reshaping results specified in the table are achieved. The workpiece surface still contains sufficient lubricant so that further drawings are possible without relubrication.

If the drawing experiments are carried out using conventional lubricants, for example based on fatty acid soaos, at best approximately equally good results can only be achieved when a separating agent or lubricant carrier coating based on iron oxalate is applied to the workpieces by chemical treatment of the surface with appropriate solutions before reshaping.

EXAMPLES 34 to 41

The lubricants from Examples 26 to 33 are in each case dissolved, together with 30% by weight of polyethylene glycol, relative to the lubricant, in a paraffinic mineral oil having the viscosity 168 $mm^2/s$ (20° C.) at a temperature of 130° C. In this fashion, 8 lubricants in the oil phase are obtained which are employed for drawing steel tubes of materials quality St 35. The following results are achieved:

| Example No. | Employed saponification product as in Example No. | Reshaping results Drawing force | Surface quality |
|---|---|---|---|
| 34 | 26 | low | good |
| 35 | 27 | very low | very good |
| 36 | 28 | low | satisfactory |
| 37 | 29 | very low | very good |
| 38 | 30 | high | adequate |
| 39 | 31 | low | good |
| 40 | 32 | high | adequate |
| 41 | 33 | high | satisfactory |

Comparably good results are achieved using conventional lubricants only when a separating or carrier coating based on zinc phosphate is applied to the tubes, in a complicated fashion, before adding the lubricant.

EXAMPLES 42 to 49

The lubricants from Examples 26 to 33 are each suspended in a liquid polyglycol which is constructed from ethylene oxide and propylene oxide units. The liquid lubricants thus obtained are employed for drawing stainless steel tubes (=Examples 42 to 49). High degrees of reshaping (up to 51%) and excellent surface qualities are achieved at low drawing forces. The same quality graduation is achieved in the experimental series as in Examples 34 to 41. The lubricants are also distinguished, in particular, by the fact that they are easily removed from the metal surface after the reshaping is complete.

EXAMPLE 50

A cylindrical steel body of materials quality St 35 is converted into a sleeve by cold extrusion. An aqueous dispersion of a polyethylene oxidate having the acid index 26, the saponification index 40, the melting point 118° C., the dicarboxylic acid content of 84% and the melt viscosity 1350 mPa s at 160° C. is employed as lubricant. The reshaping proceeds with comparatively low stamping force and minimal ejection force and leads to a dimensionally accurate article having high surface quality. If a lubricant carrier coating based on zinc phosphate is applied to the steel body before adding the lubricant, only insignificantly better shaping results are achieved.

The cold extrusion process can only be carried out using a conventional lubricant based on fatty acid soaps if the steel body is previously additionally provided with a lubricant carrier coating based on zinc phosphate.

EXAMPLE 51

A polyethylene oxidate having the acid index 68, the saponification index 99, the drip point 110° C., the dicarboxylic acid content of 93% and the melt viscosity 150 mPa s at 140° C. is saponified by stirring the oxidate melt with half the equivalent amount of calcium hydroxide. A saponification product having the acid index 32, the saponification index 72, the drip point 107° C. and the melt viscosity 1500 mPa s at 140° C. is obtained. The saponification product is employed in powder form as lubricant for drawing asymmetrical edges into a square stainless steel rod. A dimensionally accurate section having sharp edges and a high-luster surface is obtained.

The experiment is repeated, previously applying a separating agent or lubricant carrier coating based on iron oxalate to the workpiece surface by chemical treatment with an appropriate solution. Reshaping results are achieved which are further improved slightly—compared to the experiment without separating or carrier coating.

Drawing of the section without previous application of a separating or carrier coating is not possible when using conventional lubricants based on fatty acid soaps. Although drawing is possible in principle after application of a separating or carrier coating, markedly worse results are achieved, however, than in the process according to the invention, for example considerable grooving and high tool wear occur.

EXAMPLE 52

A polyethylene oxidate having the acid index 68, the saponification index 99, the drip point 110° C., the melt viscosity 150 mPa s at 140° C. and the molecular weight 1700 is esterified to an acid index of 15 using the corresponding amount of stearyl alcohol. A product, having the acid index 15, the saponification index 120, the drip point 104° C. and the melt viscosity 250 mPa s at 140° C., which is used in powder form as lubricant for cold reshaping of a square stainless steel rod into a hexagonal rod by drawing is obtained. A final product having excellent dimensional accuracy and high surface quality is obtained.

The experiment is repeated, with the difference that the polyethylene oxidate is initially esterified to an acid index of 30 using the corresponding amount of stearyl alcohol and is then saponified to an acid index of 15 using calcium hydroxide. A product having the acid index 15, the saponification index 105, the drip point 108° C. and the melt visosity 1700 mPa s at 140° C. is obtained. When the product is subsequently used as lubricant for cold reshaping of the square rod into the hexagonal rod, further improved results are achieved inasmuch as, in comparison to above, the reshaping can be carried out using lower force. Equally good results are achieved when the lubricant, merely esterified, used above is employed with admixing of fillers (talc, lime).

I claim:

1. A process for the non-cutting reshaping of metals comprising using, during said non-cutting metal reshaping, a lubricant which includes an effective lubricating amount of a synthetic lubricating agent which is at least one substance selected from the group consisting of air oxidized homopolymers of $C_2$–$C_{18}$-alkenes having a terminal double bond, air-oxidized copolymers of said $C_2$–$C_{18}$-alkenes, air-oxidized copolymers of said $C_2$–$C_{18}$-alkenes which include up to about 50% by weight of an oxygen-containing 1-olefin monomer, and esterification and/or saponification products of said air oxidized homopolymers or copolymers, and mixtures thereof, said air oxidized homopolymers or copolymers having an acid number of between 5 and 150 mg of KOH/g, a melt viscosity of between 5 and 100,000 mPa s at 160° C., a melting point above 90° C., and a dicarboxylic acid content of greater than 10% by weight.

2. A process as in claim 1, wherein said air oxidized homopolymer or copolymer is the oxidation product of at least one polymer selected from the group consisting of homo- or copolymers of ethylene, propene, 1-propene, 1-butene, 3-methyl-1-butene, 1-pentene, 1-hexene and 1-octene.

3. A process as in claim 1, wherein said air oxidized homopolymers or copolymers are formed from polymers having molecular weights of greater than 5,000.

4. A process as in claim 3, wherein said air oxidized homopolymers or copolymers are formed from polymers having molecular weights of greater than 10,000.

5. A process as in claim 1, wherein said air oxidized homopolymers or copolymers have an acid number of between 10 and 70 mg of KOH/g, a melt viscosity of between 50 and 50,000 mPa.s, at 160° C., a melting point of above 100° C., and a dicarboxylic acid content of greater than 20% by weight.

6. A process as in claim 1, wherein the esterification products of the air oxidized homopolymers or copolymers are sterified using monohydric or polyhydric alcohols, and the saponification products have univalent to trivalent metal ions or ammonium ions.

7. A process as in claim 6, wherein the lubricating agent is used, during said non-cutting metal reshapinq, in solid, suspended, dispersed or dissolved form and is directly prepared in said form by mixing the solid suspended dispersed or dissolved air oxidized homopolymers or copolymers with the solid, suspended, dispersed or dissolved esterification components or saponification components.

8. A process as in claim 7, wherein the esterification and or saponification products are used in admixture with said air oxidized polymers.

9. A process as in claim 6, wherein the esterificastion and saponification products have melting points of above 100° C., and melt viscosities of above 100 mPa.s at 180° C.

10. A process as in claim 1, further comprising using a separating agent and/or lubricant carrier during said non-cutting metal reshaping.

11. A process as in claim 1, wherein the lubricant is employed as a mixture with a suspending agent, dispersing agent or solvent which is selected from the group consisting of water, mineral oils, natural or synthetic oils, polyalkylene glycols or chlorinated hydrocarbons, and mixtures thereof.

12. A non-cutting metal reshaping lubricant which includes an effective lubricating amount of a synthetic lubricating agent which is at least one substance selected from the group consisting of air oxidized homopolymers of $C_2$–$C_{18}$ -alkenes having a terminal double bond, air oxidized copolymers of said $C_2$–$C_{18}$-alkenes, air oxidized copolymers of said $C_2$–$C_{18}$-alkenes which include up to about 50% by weight of an oxygen-containing 1-olefin monomer, and esterification and/or saponification products of said air oxidized homopolymers or copolymers, and mixtures thereof, said air oxidized homopolymers or copolymers having an acid number of between 5 and 150 mg of KOH/g, a melt viscosity of between 5 and 100,000 mPa.s at 160° C., a melting point above 90° C., and a dicarboxylic acid content of greater than 10% by weight.

13. A lubricant as in claim 12, wherein said air oxidized homopolymer or copolymer is the oxidation product of at least one polymer selected from the group consisting of homo- or copolymers of ethylene, propene, 1-propene, 1-butene, 3-methyl-1-butene, 1-pentene, 1-hexene and 1-octene.

14. A lubricant as in claim 12, wherein said air oxidized polymers are formed from polymers having molecular weights of greater than 5,000.

15. A lubricant as in claim 12, wherein said air oxidized polymers are formed from polymers having molecular weights of greater than 10,000.

16. A lubricant as in claim 12 wherein the air oxidized homopolymers or copolymers have an acid number of between 10 and 70 mg of KOH/g, a melt viscosity of between 50 and 50,000 mPa.s, at 160° C., a melting point of above 100° C., and a dicarboxylic acid content of greater than 20% by weight.

17. Lubricant composition for use in a process as in claim 1, wherein it contains an actual lubricant which is selected from the group consisting of oxidation products of polymers of 1-olefins and the esterification and saponification products of these oxidation products and mixtures thereof, said lubricant existing in solid, suspended, dispersed or dissolved form in a suspending agent, dispersing agent or solvent.

18. lubricant composition as in claim 17, wherein said lubricant composition further contains additional mixture components of other lubricant compositions.

* * * * *